US006950068B2

(12) United States Patent
Bordi et al.

(10) Patent No.: US 6,950,068 B2
(45) Date of Patent: Sep. 27, 2005

(54) METHOD OF MANUFACTURING AN INTERNAL ANTENNA, AND ANTENNA ELEMENT

(75) Inventors: Mika Bordi, Helsinki (FI); Petteri Annamaa, Oulu (FI); Esa Mikkonen, Oulu (FI); Seppo Raatikainen, Kempele (FI)

(73) Assignee: Filtronic LK Oy, Kempele (FI)

( * ) Notice: Subject to any disclaimer, the term of this patent is extended or adjusted under 35 U.S.C. 154(b) by 40 days.

(21) Appl. No.: 10/298,246

(22) Filed: Nov. 15, 2002

(65) Prior Publication Data

US 2003/0112188 A1 Jun. 19, 2003

(30) Foreign Application Priority Data

Nov. 15, 2001 (FI) ..... 20012219

(51) Int. Cl.[7] ..... H01Q 1/24
(52) U.S. Cl. ..... 343/702; 343/700 MS
(58) Field of Search ..... 343/700 MS, 702, 343/725, 729, 829, 845, 846, 872

(56) References Cited

U.S. PATENT DOCUMENTS

| | | | | |
|---|---|---|---|---|
| 5,668,560 A | * | 9/1997 | Evans et al. | 343/702 |
| 6,396,444 B1 | * | 5/2002 | Goward et al. | 343/702 |
| 6,483,463 B2 | * | 11/2002 | Kadambi et al. | 343/700 MS |
| 6,538,604 B1 | * | 3/2003 | Isohatala et al. | 343/700 MS |
| 6,646,606 B2 | * | 11/2003 | Mikkola et al. | 343/700 MS |

FOREIGN PATENT DOCUMENTS

| | | | |
|---|---|---|---|
| EP | 569016 | 11/1993 | H01Q/25/02 |
| EP | 854536 | 7/1998 | H01Q/1/38 |
| EP | 0 892 459 A1 | 1/1999 | |
| EP | 929121 | 7/1999 | H01Q/13/10 |
| EP | 1 018 777 A2 | 7/2000 | |
| EP | 1 137 097 A1 | 9/2001 | |
| SE | 516106 | 11/2001 | H01Q/1/24 |
| WO | WO 99/27607 | 6/1999 | |
| WO | WO-01/03238 A1 | 1/2001 | |
| WO | 01/08255 | 2/2001 | H01Q/1/24 |
| WO | 01/33665 | 5/2001 | H01Q/1/24 |
| WO | WO-01/56111 A1 | 8/2001 | |
| WO | WO-02/063717 A1 | 8/2002 | |

OTHER PUBLICATIONS

European Examination Report Application No. 02396167.5–1248 mailed May 30, 2005.

* cited by examiner

*Primary Examiner*—Shih-Chao Chen
(74) *Attorney, Agent, or Firm*—Darby & Darby

(57) ABSTRACT

The invention relates to a method of manufacturing a structure suitable as an internal antenna in small radio devices, and an antenna element to which the method is applied. The antenna element comprises a radiating plane and additionally e.g. supportive elements, a feed conductor and short-circuit conductor as well as extensions to increase capacitance. The antenna element is fabricated by first extruding from a billet an antenna billet, and working the latter as required. The antenna billet may be symmetrical so that two antenna elements will be produced when it is cut in half. Advantageously the antenna element is fabricated so as to conform with the covering of the device in which it is placed. It may also be part of a covering of a device. The manufacturing costs of the antenna element are relatively low and the radio characteristics of the element are good. An antenna structure employing the element has got few separate parts and is mechanically firm and space-conserving.

17 Claims, 5 Drawing Sheets

METHOD OF MANUFACTURING AN INTERNAL ANTENNA, AND ANTENNA ELEMENT

FIELD OF INVENTION

The invention relates to a method of manufacturing a structure suitable as an internal antenna especially in small radio devices. Furthermore the invention relates to an antenna element resulting from the application of the method.

BACKGROUND OF THE INVENTION

Manufacturing costs of apparatuses in general and mass products in particular should be as low as possible. The less there are parts in a structure and work stages in manufacturing the parts, the lower the costs. Furthermore, in portable radio devices, the mechanical stability of a structure is emphasized. For example, in a high-frequency antenna, even a slight mechanical change may render the whole device unusable. The less there are parts in a structure and the sturdier and better protected the parts, the better the stability and, hence, the reliability of the structure. So, a low count of parts helps both minimize the manufacturing costs and improve the reliability of a device.

Figure 1A:
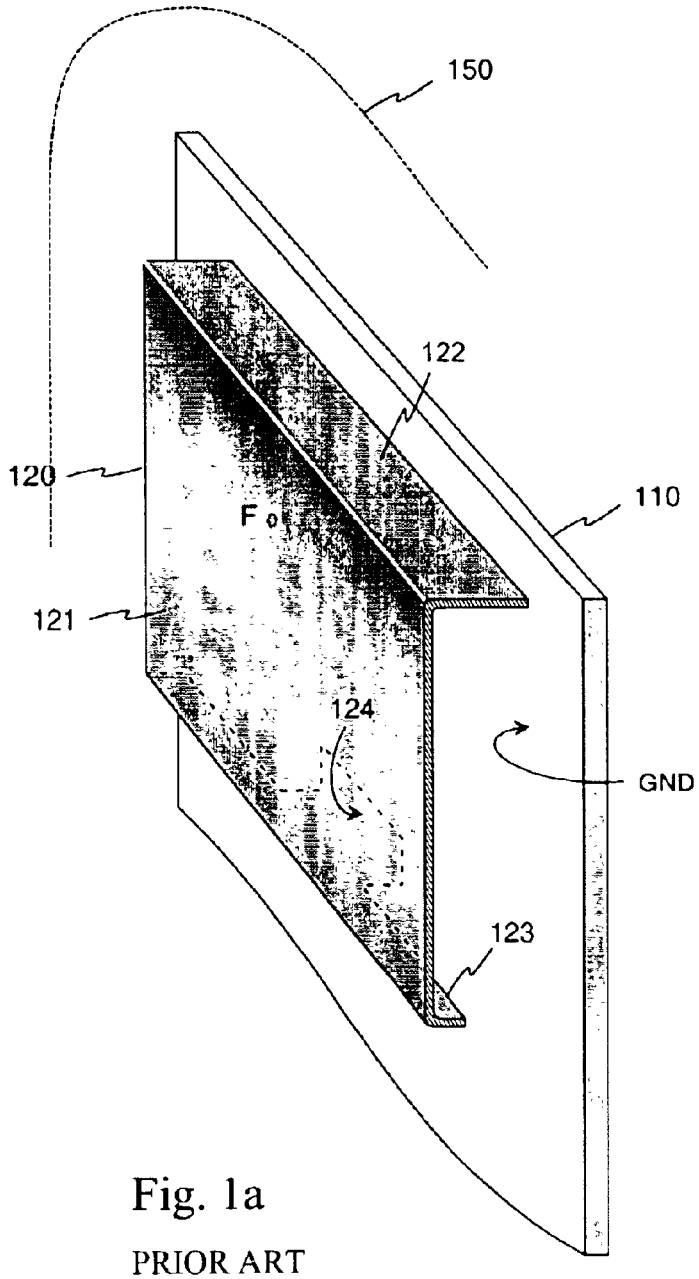
Fig. 1a PRIOR ART
Figure 1B:
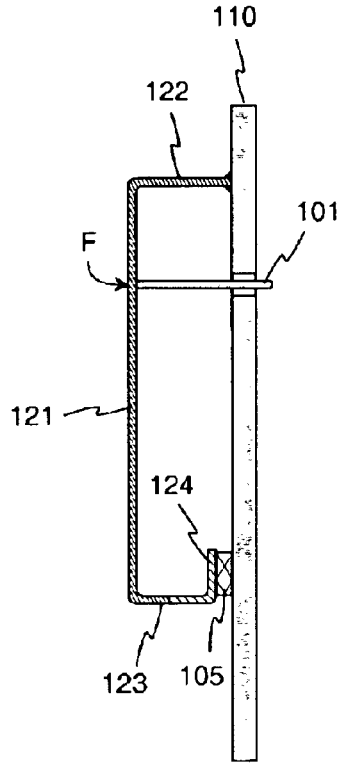
Fig. 1b PRIOR ART

As far as antennas are concerned, protruding antennas, largely used in mobile stations, for instance, are susceptible to damage, and with the necessary additional parts they significantly add to the manufacturing costs. Internal antennas in mobile stations are usually planar antennas because these have good electrical characteristics with respect to the antenna size. FIGS. 1*a* and 1*b* illustrate an example of such known planar antennas. This structure is disclosed in publication WO 01/08255. FIG. 1*a* is a perspective of the antenna and FIG. 1*b* shows a lateral view of the same structure. FIG. 1*a* shows, within the covering 150 of a radio device, a printed circuit board 110, depicted here in vertical position, and on one side of the circuit board a conductive layer providing a ground plane GND for the antenna. A central part in the structure is the antenna element 120, which is in single piece and comprises the radiating plane 121 proper, a first bent portion 122, a second bent portion 123, and a third bent portion 124. Connected to the rectangular radiating plane 121 at a point F of its vertical center line is a feed conductor 101 of the antenna. The antenna element extends, after a bend, from the upper edge of the radiating plane up to the ground plane, perpendicularly thereto. The first bent portion 122 thus formed functions as a short-circuit conductor having the length of that particular edge of the radiating plane, and the antenna is a so-called planar inverted-F antenna, or PIFA. The antenna element also extends from the edge opposite to the short-circuited edge towards the ground plane, after a bend. The middle section of the second bent portion 123 thus formed extends near the ground plane. In the middle section there is a rectangular bend inside the structure. Between the resulting third bent portion 124 and the ground plane, which are parallel, there is a significant capacitance, further increased by a dielectric plate 105 disposed therebetween. In addition to certain electrical characteristics, non-substantial here, an advantage of the structure is that the radiating plane is supported to the ground plane through the bent portions of the antenna element without separate supporting parts. The antenna element is fabricated by stamping an appropriately shaped piece from a rigid conductive sheet and bending it. In addition, antenna fabrication includes, as separate work stages, the attachment of the feed conductor 101 to the radiating plane and said dielectric plate 105 to the antenna element, as well as the attachment of the resulting assembly to the printed circuit board.

From publication WO 01/33665 it is known a structure which is similar to the one described above but which additionally has a parasitic antenna element to increase the number of operating bands, for example. The publication concerns, apart from the structure, also the manufacturing method thereof, which includes as a separate stage the connecting of the feed conductor to the antenna element. In this case, too, both antenna elements are made by stamping and bending a conductive sheet.

SUMMARY OF THE INVENTION

An object of the invention is to provide a manufacturing method of a planar antenna more advantageous than prior-art methods and an antenna structure better than prior-art structures. The method according to the invention is characterized in that which is specified in the independent claim 1. The antenna element according to the invention is characterized in that which is specified in the independent claim 11. Some advantageous embodiments of the invention are presented in the dependent claims.

The basic idea of the invention is as follows: The central part of an antenna is a rigid, single-piece, conductive antenna element to be placed inside a radio device and comprising a radiating plane. In addition, the antenna element may comprise e.g. support elements for the radiating plane, a feed conductor and a short-circuit conductor as well as extensions to increase capacitance. Antenna elements are advantageously fabricated by first extruding from a base billet an antenna billet with a symmetrical structure, working the antenna billet as required, and then cutting it into two antenna elements. An antenna element may be coated with an anti-corrosive material which improves the electrical conductivity of the elements. Advantageously an antenna element is fabricated so as to conform with the outer contours of the device in which it is placed.

An advantage of the invention is that the manufacturing costs of an antenna element are relatively low. This is a consequence of the fact that the elements can be fabricated using a relatively small number of work stages. Another advantage of the invention is that the radio frequency characteristics of an element according to the invention are good as there are no metallic junctions. A further advantage of the invention is that an antenna structure according to the invention is reliable in use. This is a result of the small number of parts and mechanical firmness of the structure. A yet further advantage of the invention is that an antenna structure according to the invention is space-conserving as the radiating plane conforms to the inner surface of the host device.

BRIEF DESCRIPTION OF THE DRAWING FIGURES

Figure 5:
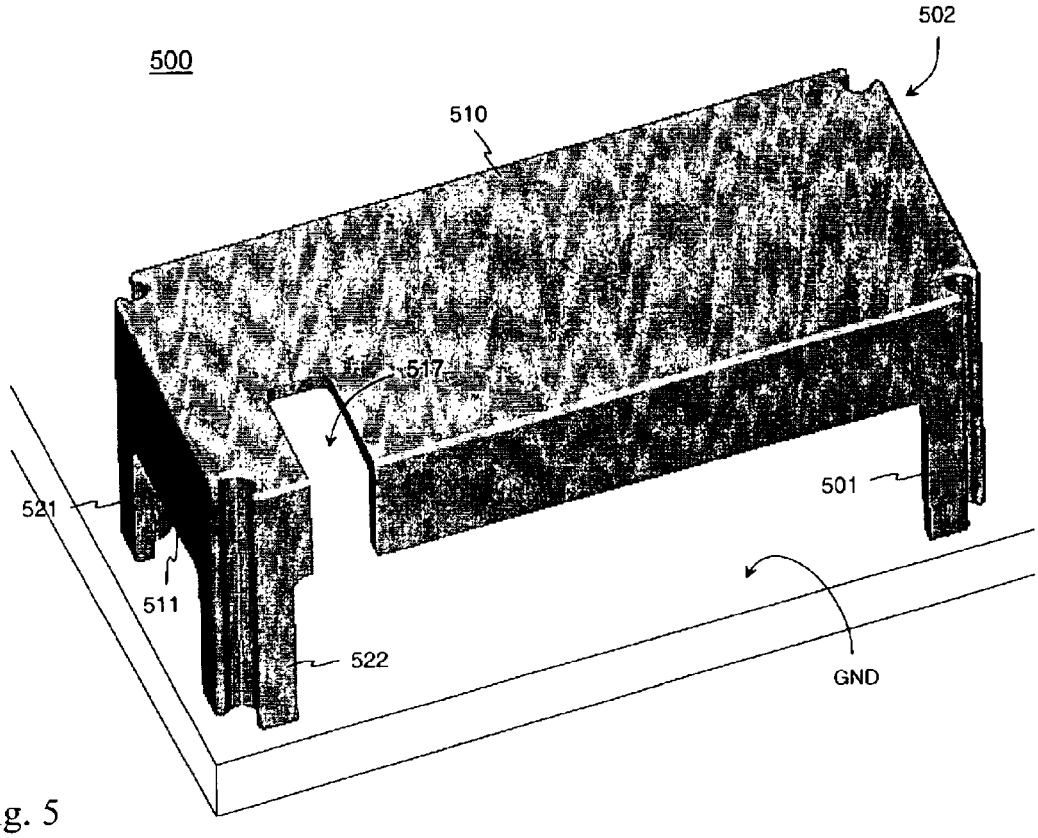
Figure 6:
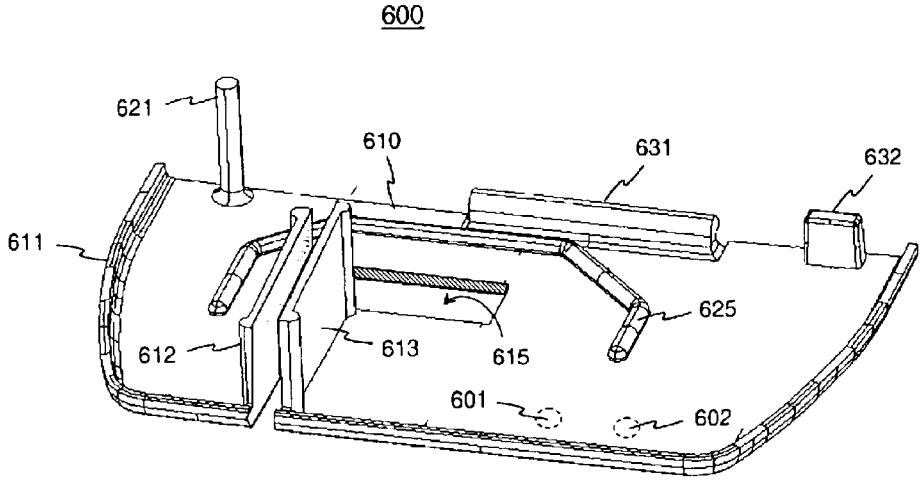
Figure 7:
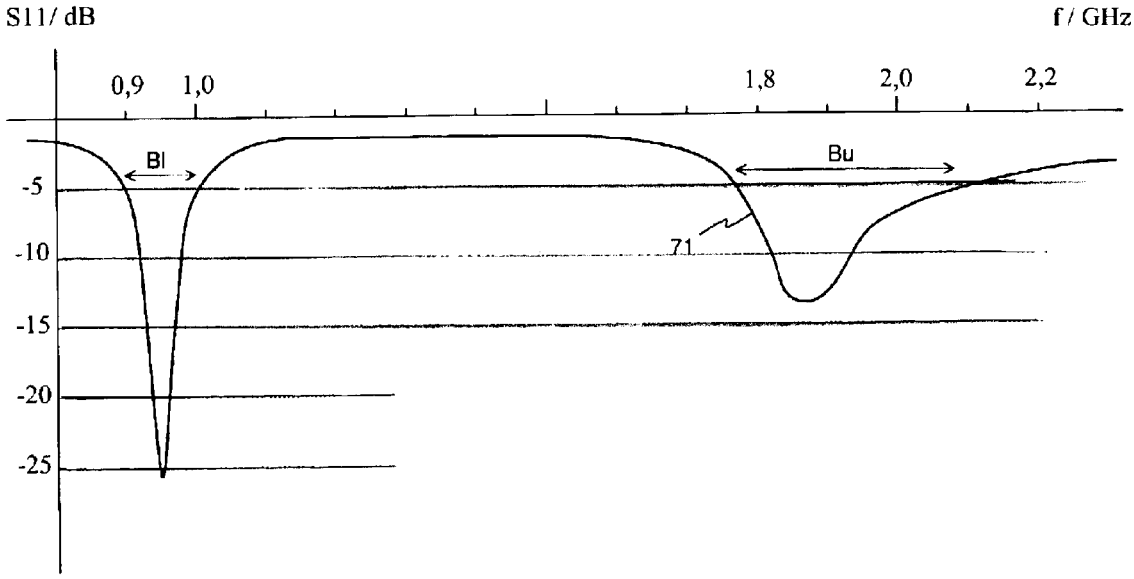
Figure 8:
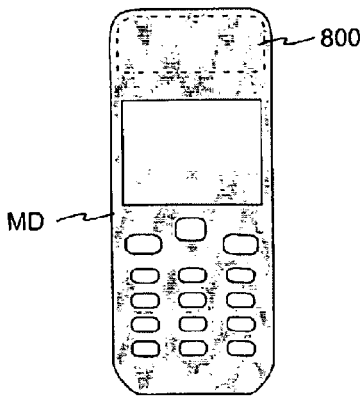

The invention is below described in detail. Reference is made in the description to the accompanying drawings where FIGS. 1*a,b* show an example of a prior art internal antenna, FIG. 2 shows an example of an antenna billet according to the invention, FIG. 3 shows an example of the manufacturing method according to the invention, FIGS. 4*a,b* show an example of an antenna element according to the invention, FIG. 5 shows a second example of an antenna element according to the invention, FIG. 6 shows a third example of an antenna element according to the invention, FIG. 7 shows an example of frequency characteristics of an antenna employing an antenna element according to the invention, FIG. 8 shows an example of a radio device having an antenna according to the invention.

DETAILED DESCRIPTION OF ILLUSTRATIVE EMBODIMENTS

FIG. 1 was already discussed in conjunction with the description of the prior art.

Figure 2:
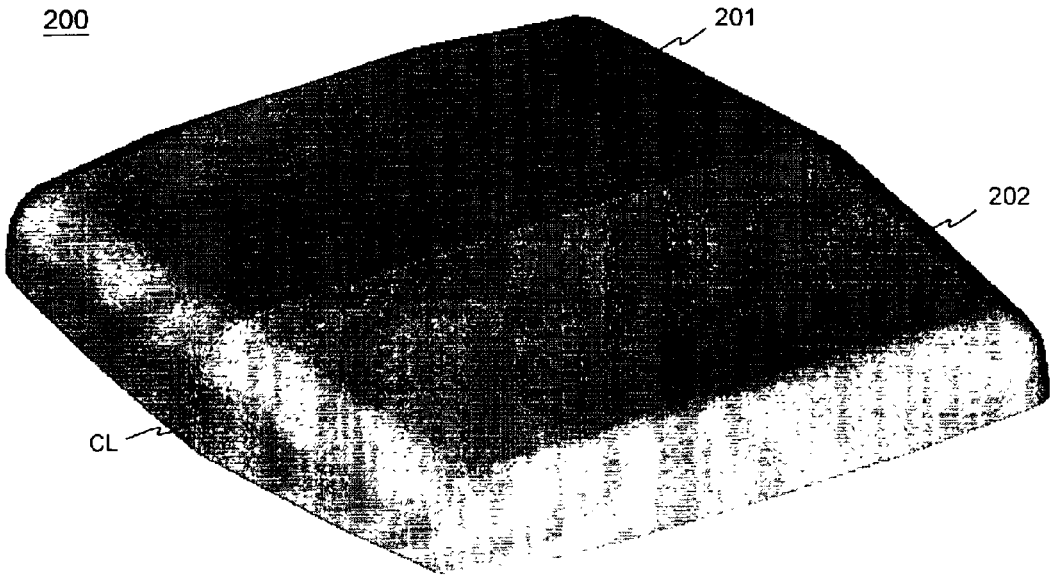
Figure 3:
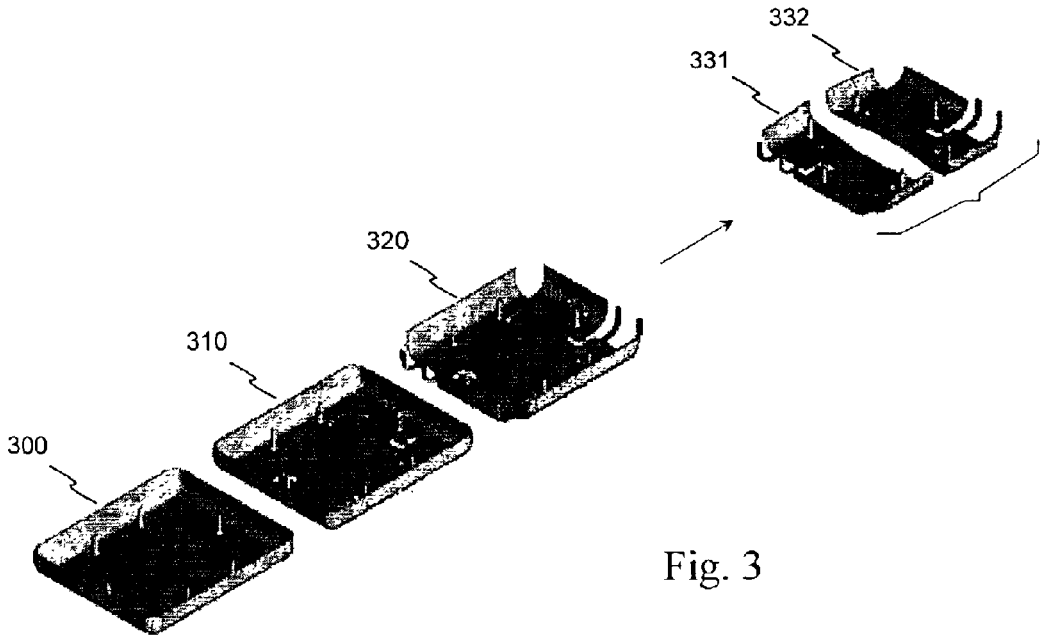

FIG. 2 shows an example of an antenna billet according to the invention viewed from above. An antenna billet means in this description and in the claims a piece extruded from a basic billet, having at least one antenna element-shaped part. The single-piece antenna billet 200 comprises a first half 201 and a second half 202 separated by a center line CL marked in broken line in the example depicted in FIG. 2. The halves are identical in form and composition and are located symmetrically in the antenna billet. Such a symmetrical structure of an extrusion piece is advantageous as regards the extrusion process. The edges of the antenna billet 200 are curved so that the shape of the outer surfaces of the halves conforms to the shape of the inner surface of the covering of the radio device in which the antenna is to be placed.

FIG. 3 shows an example of manufacturing stages of antennas according to the invention. The first intermediate stage is an antenna billet 300 corresponding to the block shown in FIG. 2. Shown in FIG. 3 is the underside i.e. the space confined within the curved edges of the billet. In the space inside the antenna billet there are small pegs rising from the flat portion, three in both halves. The pegs are formed in the same extrusion process as the whole antenna billet, and they are meant to support the antenna element once installed. Next, the slot patterns of the antenna elements are formed by punching out material in the flat portion of the antenna billet. The slot patterns may also be preliminarily formed in the extrusion stage, in which case punching will give them their final precise shape. The result is a second-stage element 310. By means of the slot pattern the antenna will have a dual-band, for example, and the resonance frequencies corresponding to the bands can be arranged suitable. Feed and short-circuit conductors are produced next by cutting out material from the curved edges of the second-stage element 310. At the same time, edges can be shaped in other ways, too. The result is a third-stage element 320. So, in this process, the feed conductor and short-circuit conductor will form a unitary piece together with the radiating plane of the antenna element. The shaping of the element's edges will have an effect on the capacitance between the radiating parts and the ground plane in a completed antenna assembly and, hence, on the electrical length of the radiating parts.

In the last stage in the example of FIG. 3 the third-stage element 320 is cut in half so that two identical antenna elements will be produced, a first 331 and a second 332 antenna element. The manufacturing process may then go on with a surface treatment of the antenna elements. An element may be coated with anti-corrosive material, for example. The coating material may also be chosen such that it has a very good electrical conductivity which will reduce antenna loss factors.

Figure 4A:
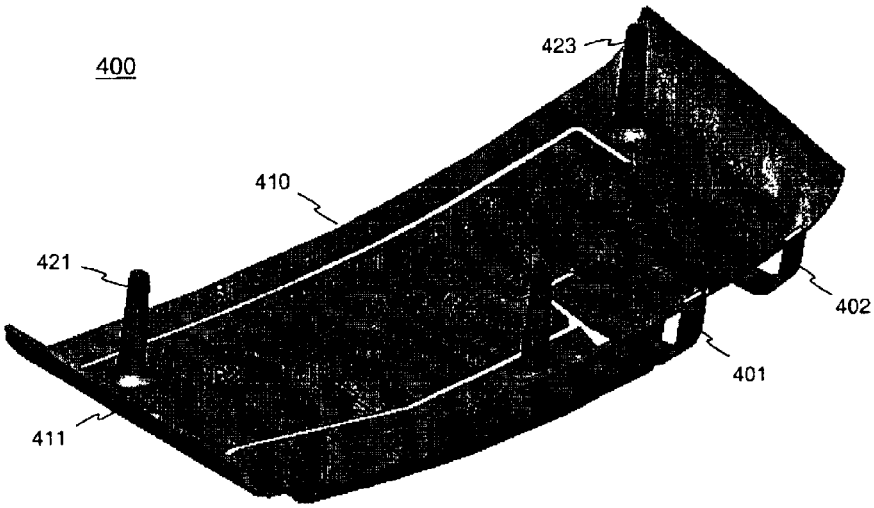
Figure 4B:
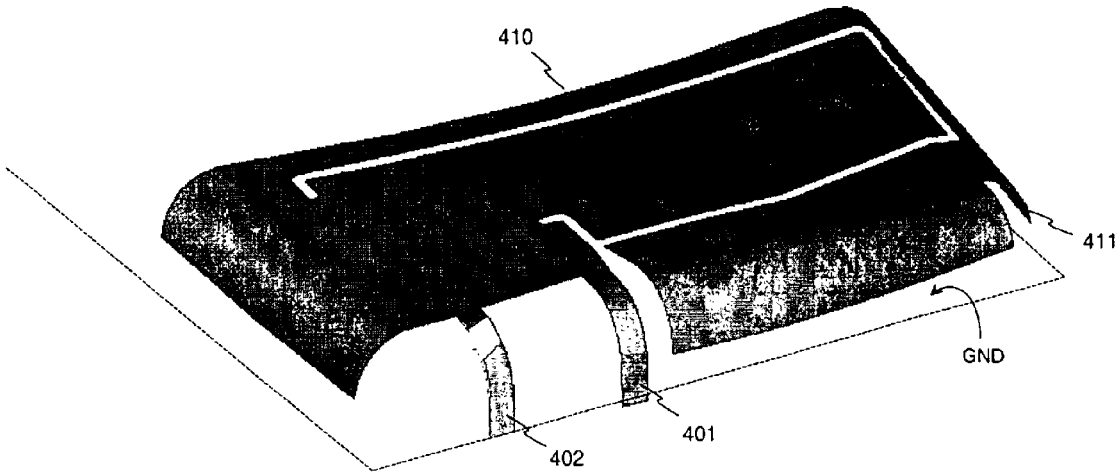

FIGS. 4*a* and 4*b* show an example of an antenna element according to the invention. The antenna element 400, depicted magnified, is the same as one of the antenna elements 331, 332 resulting from the process described above. FIG. 4*a* shows the inside of the antenna element 400, and FIG. 4*b* shows the outside of the element, turned over from the position of FIG. 4*a*. The element comprises a radiating plane 410, antenna feed conductor 401, short-circuit conductor 402 as well as a first 421, second 422 and a third 423 support leg. Three edges of the radiating plane have curved extensions. A reference line marks the curved extension 411 at one of the shorter ends of the radiating plane. In a finished assembly the curved portions are directed towards the ground plane, as shown in FIG. 4*b*. Such a design will add to the capacitance at the edges of the radiating plane, increasing the electrical lengths of the antenna parts, thus reducing the need for space in an antenna operating in certain frequency bands. The curved portions may be made to conform to the shape of the covering of the radio device, which in turn means efficient use of space within the radio device. The feed conductor and short-circuit conductor of the antenna in the example of FIGS. 4*a,b* are joined to the edge of the radiating plane and they, too, are curved in compliance with the contour of the inner surface of the covering of the radio device.

The three support legs 421, 422, 423 are spread in the flat portion of the radiating plane 410. When installing the antenna element 400, the free ends of the support legs will be pressed by a spring force against the board on which the ground plane lies. If necessary, they may also be attached to the board by gluing or riveting, for example. Naturally the support legs are galvanically isolated from the ground plane so as not to prevent the antenna from functioning. In helping to achieve this aim, the locations of the support legs are chosen such that the electromagnetic field of the antenna is relatively weak there.

In the example of FIGS. 4*a,b* the radiating plane 410 has a slot 415 which begins from the edge of the plane near the feed conductor 401 and ends in the inner region of the plane. The route of the slot is such that, viewed from the antenna feed area, there are created two branches of different lengths in the radiating plane, including the extensions thereof. The antenna has then got two operating bands. The first branch B1 encircles along the edges of the radiating plane almost around the whole plane, and the second, shorter branch B2 lies in the central region of the plane, surrounded by the first branch.

FIG. 5 shows a second example of an antenna element according to the invention. The antenna element 500 comprises a radiating plane 510, antenna feed conductor 501, short-circuit conductor 502 as well as a first 521 and a second 522 leg. Said two conductors and two support legs are located in the corners of the rectangular radiating plane which is supported by all four corner conductors equally. The radiating plane has got extension parts directed from the edges towards the ground plane GND. A reference line marks the extension 511 of one of the shorter ends of the radiating plane. In this case, too, the extension parts reduce the size of an antenna operating in a certain frequency range. Moreover, the extension parts improve the mechanical firmness of the structure as they are joined, at least by one end, to the above-mentioned support parts in the corners.

In the example of FIG. 5 the radiating plane 510 has a relatively short and wide slot 517 with which the resonance frequency of the antenna is arranged right. If the length of the slot is 3 mm and width 2 mm, and the length of the whole antenna element 12 mm, width 5 mm and height 5 mm, then the structure is applicable as an antenna in Bluetooth products.

FIG. 6 shows a third example of an antenna element according to the invention. The antenna element 600 comprises a radiating plane 610, support leg 621, first capacitance plate 612 and second capacitance plate 613. In this example the antenna element is designed to serve as part of the covering of a radio device. Therefore, three outer sides of the radiating plane, which correspond to an end of a radio device, have a curved rim 611, and the antenna element further includes element locking parts 631, 632 on the fourth side of the radiating plane. Prior to installation, the element is naturally coated on the outside with a dielectric material.

In this example, the feed and short-circuit conductors of the antenna are not integrated in the antenna element. The feed point 601 and short-circuit point 602 are marked on the radiating plane by dashed lines in FIG. 6. The radio device advantageously includes feed and short-circuit conductors of the spring contact type. When the antenna element 600 is pressed into its place, these contacts make a galvanic coupling with said points on the radiating plane. The radiating plane has a slot 615 which starts from the edge thereof and makes a rectangular turn so that the plane is divided into two branches of different lengths, as viewed from the short-circuit point 602. The antenna thus has got two operating bands. Said capacitance plates are located on opposing sides of that portion of the slot 615 which starts from the edge of the element, and they are standing perpendicularly against the radiating plane. The first capacitance plate 612 is thus located at the electrically farthest end of the longer branch of the radiating plane, and the second capacitance plate 613 is located at the electrically farthest end of the shorter branch of the radiating plane. Both the mutual capacitance of the capacitance plates and their capacitances with the ground plane (not shown in FIG. 6) cause the radiating branches to become electrically longer. This reduces the size of an antenna operating in certain frequency bands.

FIG. 6 also shows a U-shaped ridge 625 on the radiating plane 610. Its purpose is to add to the mechanical firmness of the antenna element 600.

FIG. 7 shows an example of frequency characteristics of an antenna structure corresponding to FIG. 4*b* when the length of the antenna element is 35 mm and height 8 mm. Curve 71 represents the change in reflection coefficient S11 as a function of frequency. It is seen that the lower operating band B1 is about 0.9 to 1.0 GHz, which is enough for EGSM (Enhanced Global System for Mobile telecommunications). The upper operating band Bu is about 1.76 to 2.06 GHz, which is enough for PCN (Personal Communication Network), for instance.

FIG. 8 shows a radio device MD having an internal antenna. The central part of the antenna is the antenna element 800 according to the invention.

A single-piece antenna element according to the invention can be manufactured using extrusion, as said earlier. Another, similar, technique is cold stretch, in which the billet already has the right thickness. The claims do not discriminate between these two related techniques, but the term "extrusion" covers them both. In the method described above, the support elements of the antenna element are formed in the same work stage as the whole antenna billet. Supportive elements may also be attached to the antenna billet after the fabrication of the latter. The antenna element may be designed to be attached, in addition to the ground plane board, to the inner surface of the covering of the radio device. As said, the outer cover may be just surface material of the antenna element serving as part of the principal covering. The shape of the antenna element may naturally vary a lot from the shapes described in the examples. The inventional idea may be applied in different ways within the limits defined by the independent claim 1.

We claim:

1. A method of manufacturing an internal antenna for a radio device by forming a single-piece conductive antenna element comprising a radiating plane of the antenna, the method comprising the steps of;

extruding an antenna billet, having substantially a shape of the antenna element, from a basic billet;

the extruded antenna billet comprises extensions of the radiating plane including a feed conductor, a short-circuit conductor, and at least one other extruded conductive support leg; and removing conductive material from the antenna billet so as to shape at least one of the radiating plane of the antenna and one of the extensions.

2. The method according to claim 1, further comprising the step of:

cutting apart two symmetrically facing halves of the antenna billet having substantially the shape of the antenna element so as to produce two mutually identical antenna elements.

3. The method according to claim 1, wherein the basic billet is extruded so that said extensions of the radiating plane further comprise at least one part which substantially increases the electrical length of the radiating plane.

4. The method according to claim 1, wherein the step of removing the conductive material from the antenna billet is achieved by punching its planar portion.

5. The method according to claim 1, wherein the step of removing the conductive material from the antenna billet is achieved by cutting an extension of its planar portion.

6. The method according to claim 1, further comprising the step of surface treating the antenna element.

7. The method according to claim 6, when the step of surface treating comprises the step of coating at least part of the antenna element with anti-corrosive material which conducts electricity better than the material of the antenna element.

8. The method according to claim 6, wherein the step of surface treating comprises the step of coating of the outer surface of the antenna element with dielectric material.

9. An antenna element in an internal antenna of a radio device, which element is a unitary extrusion piece comprising a radiating plane and extensions thereof;

the extruded extensions including a feed conductor, a short-circuit conductor, and at least one other extruded conductive support leg.

10. The antenna element according to claim 9, wherein said extruded extensions of the radiating plane further comprise at least one part which substantially increases the electrical length of the radiating plane.

11. The antenna element according to claim 9, wherein the extruded feed conductor, short-circuit conductor, and support leg are located in corners of the radiating plane.

12. The antenna element according to claim 11, wherein at least one extension, which increases the electrical length of the radiating plane, joins to at least one of said feed conductor, short-circuit conductor, and support leg so as to enhance the firmness of the antenna element.

13. The antenna element according to claim 9, wherein the at least one support leg is located at a point where the electromagnetic field, when the antenna resonates, is substantially weaker than in antenna space on average.

14. The antenna element according to claim 9, wherein its shape conforms with a shape of a portion of a cover of the radio device.

15. The antenna element according to claim 14, wherein the antenna element is part of the cover of the radio device.

16. The antenna element according to claim 9 further including a surface material which is anti-corrosive and improves electrical conductivity.

17. A radio device having an internal antenna, which antenna comprises an antenna element which is a unitary extrusion piece comprising a radiating plane and extensions thereof;

the extruded extensions including a feed conductor, a short-circuit conductor, and at least one other extruded conductive support leg.

* * * * *